United States Patent [19]

Kobayashi

[11] Patent Number: 4,913,435

[45] Date of Patent: Apr. 3, 1990

[54] GOLF CLUB AND A SET OF GOLF CLUBS

[75] Inventor: Masashi Kobayashi, Matsudo, Japan

[73] Assignee: Maruman Golf Co., Ltd., Tokyo, Japan

[21] Appl. No.: 88,452

[22] Filed: Aug. 24, 1987

[30] Foreign Application Priority Data

Aug. 29, 1986 [JP] Japan ..... 61-201762

[51] Int. Cl.[4] ..... A63B 69/36

[52] U.S. Cl. ..... 273/77 A; 273/81.4; 273/164; 273/169; 273/167 H; 273/183 D

[58] Field of Search ..... D21/214, 220; 273/77 A, 273/183, 186 A, 186 C, 163 R, 164, 167 J, 175, 167 R, 81.4, 167 F, 167 D, 163 A

[56] References Cited

U.S. PATENT DOCUMENTS

| | | | |
|---|---|---|---|
| D. 89,332 | 2/1933 | Bartsch | D21/214 |
| D. 244,703 | 6/1977 | Guzzle et al. | D21/220 |
| 1,965,954 | 7/1934 | Davis | 273/175 X |
| 2,437,404 | 3/1948 | Robinson | 273/81.4 |
| 2,859,972 | 11/1958 | Reach | 273/164 |
| 3,655,188 | 4/1972 | Solheim | 273/80 C X |
| 3,722,887 | 3/1973 | Cochrans et al. | 273/164 X |
| 4,123,055 | 10/1978 | Brill | 273/77 A |
| 4,550,914 | 11/1985 | McCallister | 273/183 C |
| 4,715,601 | 12/1987 | Lamanna | 273/77 A |

FOREIGN PATENT DOCUMENTS

| | | | |
|---|---|---|---|
| 310209 | 4/1929 | United Kingdom . | |
| 2117254 | 10/1983 | United Kingdom | 273/77 A |

OTHER PUBLICATIONS

"Bob Addie", The Washington Post, Jun. 30, 1977.

*Primary Examiner*—Carl D. Price

*Attorney, Agent, or Firm*—Armstrong, Nikaido, Marmelstein, Kubovcik & Murray

[57] ABSTRACT

An iron club and a set of iron clubs are so arranged that the causes of slicing of a ball are eliminated as much as possible. A pair of boundary lines defining a scored zone provided on a head face appear, to a player, to extend in parallel with a straight line along which the club should be swung. The iron club and the set of iron clubs are also characterized by other features which prevent slicing of the ball.

14 Claims, 3 Drawing Sheets

Fig. 1
PRIOR ART
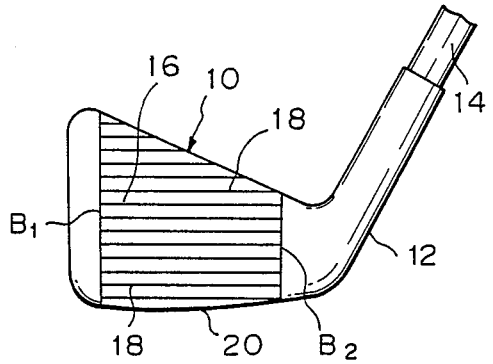
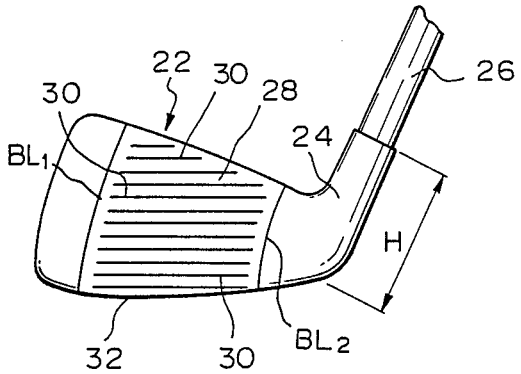
Fig. 2
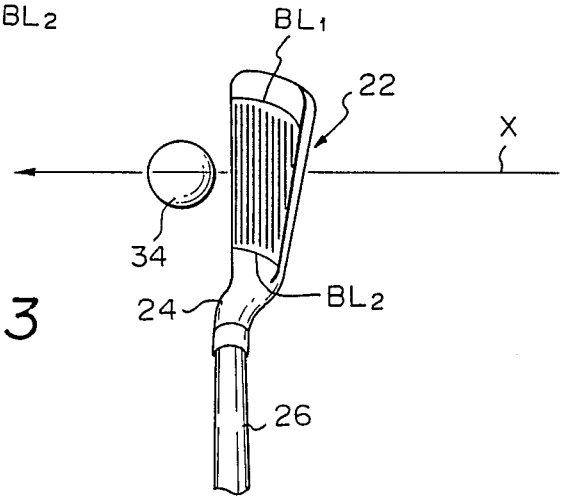
Fig. 3

GOLF CLUB AND A SET OF GOLF CLUBS

BACKGROUND OF THE INVENTION (1) Field of the Invention

The present invention relates to a golf club, and more particularly, to the type of golf clubs commonly known as "irons".

(2) Description of the Related Art

In golf, the term "slice" means that when a ball is hit by, for example, a right-handed player, the trajectory of the ball in flight is greatly deviated to the right with respect to the intended straight line of flight. In general, players, especially beginners, are liable to slice the ball when using an iron club, and this tendency to slice becomes more pronounced as a shaft of the iron club becomes longer.

A cause of slicing by players, especially beginners, is their tendency to swing the iron club from the "outside-in", i.e., the orbit of the downswing of the iron club passes across the ideal swing line from the outside to the inside.

For this reason, there is a demand for an iron club and a set of iron clubs which will enable players, especially beginners, to avoid the "outside-in swing" when using an iron club, that is, will enable them to swing an iron club in an ideal, i.e.; straight line, orbit.

FIG. 1 shows an example of a head of a conventional iron club, generally designated by a reference 10. The head 10 includes a neck 12 integrally formed therewith and connected to a shaft 14. The head 10 is provided with a face 16 having a scored zone on which score lines 18 are formed in parallel with a sole 20 of the head 10, and which is in contact with the ball when the ball is hit by the head 10. When addressing the ball before swinging, the head 10 is oriented so that the sole 20 thereof is parallel with the ground, and when the ball is struck by the scored zone of the face 16, a back spin is imparted to the ball by the score lines 18, which run parallel to the sole 20 and thus the ground.

As shown in FIG. 1, the scored zone of the face 16 on which the score lines 18 are formed is defined by boundary lines $B_1$ and $B_2$. As is well known, the boundary lines $B_1$ and $B_2$ may be formed in many different ways. For example, the scored zone may be distinguished from the other zones of the face 16 by using different materials for the scored zone and the other zones, so that the boundary lines $B_1$ and $B_2$ clearly differentiate the scored zone and the other zones. As another example, the scored zone may be subjected to a surface treatment which is different from that applied to the other zones, thereby forming the boundary lines $B_1$ and $B_2$ between the scored zone and the other zones. Furthermore, the boundary lines $B_1$ and $B_2$ can be formed as grooves between the scored zone and the other zones.

Conventionally, the boundary lines defining the scored zone are formed on the head face in a direction perpendicular to the head sole, as exemplified in FIG. 1. With this arrangement of the boundary lines, when a player using the iron club having a conventional head as shown in FIG. 1 addresses the ball, the player will see the boundary lines as lines not extending in parallel with the straight line passing through the center of the ball. In particular, the boundary lines will appear to extend obliquely from left to right with respect to the above straight line. Of course, if a spectator observes the head from a point just above the ball while the player is addressing the ball, the spectator will see the boundary lines extending in parallel with the straight line.

To hit the ball without slicing, the player must swing the club in a straight line, as mentioned above. However, with the arrangement of the boundary lines of the conventional head face, the player, especially a beginner, is liable to move the club on the backswing so that the club head is moved in a direction designated by the boundary lines which appear to extend obliquely from left to right with respect to the straight line, and thus the downswing of the club will be in the "outside-in" manner. This tendency becomes more pronounced as the club shaft becomes longer, since, to the player, the boundary lines will appear to extend more and more obliquely from left to right with respect to the straight line as the club shaft becomes longer.

An iron club having a longer shaft also provides another cause of slicing. Namely, the resilience of the club shaft allows it to bend at the beginning of a downswing of the club due to the inertial mass of the club, especially the head thereof. As the club shaft becomes longer, this bending becomes greater and thus the club head hits the ball before the club shaft is restored from the bent condition to a straight condition. In other words, the club head may hit the ball in an "open face" manner, thereby causing the player to slice the ball.

It is possible to prevent the club head from hitting the ball in the "open face" manner by delaying the timing of the impact of the club head with the ball until the club shaft has straightened, so that the head face is square to the ball at the moment of impact. The timing of the impact of the club head with the ball can be adjusted by varying a relative position of a leading edge of the club head with respect to the club shaft. In particular, by increasing an offset distance between the leading edge of the club head and an axis of the club shaft, or a goose distance between the leading edge of the club head and a leading side of the club shaft or the neck, it is possible to delay the impact timing so that the club head will hit the ball squarely. However, there are no conventional sets of iron clubs wherein the offset distance or the goose distance has been regulated in response to a length of the club shafts for adjusting the timing of the impact of the club head with the ball.

Another factor which causes slicing by players, especially beginners, is their tendency to bring the club head into contact with the ball at a point outside of a sweet point and toward a toe of the club head, which causes a rotation of the club head around the center of gravity thereof upon impact with the ball. This rotational movement of the club head is also a cause of slicing.

Yet another cause of slicing by players, especially beginners, is that their grip on the iron club may be too loose, and thus the club is allowed to rotate within the hands of the player when the club head hits the ball. This rotational slippage of the club in the hands of the player is also a cause of slicing.

SUMMARY OF THE INVENTION

Accordingly, an object of the present invention is to provide an iron club and a set of iron clubs which will eliminate the above-mentioned causes of slicing as much as possible.

An iron club according to the present invention comprises a shaft, a head provided at one end of the shaft, and a grip provided at the other end of the shaft. The iron club also comprises indication means provided on the head for indicating a direction in which a player should move the club on the backswing when addressing the ball so as to ensure that the downswing is on a straight line. The indication means includes a pair of boundary lines which define a scored zone formed on a face of the head, the pair of boundary lines extending upwardly from a sole of the head and obliquely toward a heel side of the head in such a manner that the pair of boundary lines appear to substantially extend in parallel with a straight line when the player addresses the ball.

Also, according to the present invention, there is provided a set of iron clubs each having a shaft, a head provided at one end of the shaft, and a grip provided at the other end of the shaft. Each of the iron clubs comprises indication means provided on the head for indicating a direction in which a player should move the club on the backswing when addressing the ball so as to ensure that the downswing is on a straight line. The indication means includes a pair of boundary lines which define a scored zone formed on a face of the head, the pair of boundary lines extending upwardly from a sole of the head and obliquely toward a heel side of the head in such a manner that the pair of boundary lines appear to substantially extend in parallel with a straight line when the player addresses the ball. In the set of iron clubs, an offset distance between a leading edge of the head and an axis of the shaft or a goose distance between a leading edge of the head and a leading side of the shaft is increased as the length of the shaft is increased so that a timing of an impact of the head with a ball is further delayed in accordance with the increase in the length of the shaft.

Preferably, the pair of boundary lines describe a pair of circular arcs in parallel with each other so that, to the player, they appear to accord with an orbit of a swing of the head during a straight line, whereby the player can swing the iron club along a straight line by moving the club on the backswing along the direction indicated by the boundary lines.

Preferably, a toe profile of the head is shaped obliquely and thus in parallel with the pair of boundary lines, in such a manner that a weight distribution of a body of the head is toward the toe side thereof, whereby the moment of inertia of the head body is increased. With this arrangement, it is possible to enhance a tendency of the player to swing the iron club along a straight line. Also, although the head hits the ball at a point outside of the sweet point toward the toe side of the club head, the head body does not rotate around the center of gravity of the head body because of the increase of the moment of inertia thereof.

Preferably, a neck of the head has a length which is less than 55 mm, so that a weight distribution of the head is toward the head body rather than the neck thereof, whereby the moment of inertia of the head body is further increased. This increase of the moment of inertia contributes to a prevention of the rotation of the head body when the head face hits the ball at the point outside of the sweet point toward the toe side of the club head.

The head may have a recess formed in the back face thereof, and disposed in the vicinity of the heel side of the head, so that a weight distribution of the head body is toward the toe side thereof, whereby the moment of inertia of the head body is further increased. This arrangement also contributes to a prevention of the rotation of the head body as mentioned above.

The grip may have a ridge element formed on its outer surface, which extends along an axis thereof, so that a rotational slippage between the grip and the hands of the player is prevented when the head hits the ball.

BRIEF DESCRIPTION OF THE DRAWINGS

The above and other objects of the present invention will be better understood from the following description, with reference to the accompanying drawings, in which:

FIG. 1 illustrates a head of a prior iron club;

FIG. 2 illustrates a head of an iron club in accordance with the present invention;

FIG. 3 illustrates the club head of FIG. 2 viewed from above while addressing;

FIG. 7(*b*) illustrates a head of a middle iron club in accordance with the present invention; and FIG. 7(*c*) illustrates a head of a short iron club in accordance with the present invention.

DESCRIPTION OF THE PREFERRED EMBODIMENTS

Figure 4:
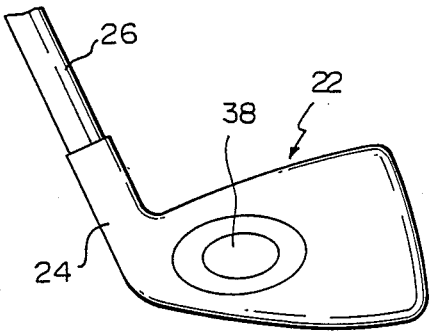
FIG. 4 illustrates the club head of FIG. 2 viewed from the back thereof.

FIG. 2 shows a head of an iron club according to the present invention, generally designated by a reference numeral 22. The club head 22 includes a neck 24 integrally formed therewith and connected to a shaft 26. The club head 22 is provided with a face 28 having a scored zone on which score lines 30 are formed in parallel with a sole 32 of the head 22 and which is in contact with a golf ball when the ball is hit by the head 22.

As shown in FIG. 2, the scored zone of the club head 22 on which the score lines 30 are formed is defined by a pair of boundary lines $BL_1$ and $BL_2$, which may be formed on the head face 28 in various ways, as explained hereinbefore in connection with the prior art (FIG. 1). According to the present invention, the boundary lines $BL_1$ and $BL_2$ are arranged so that they extend upwardly from the sole 32 of the club head 22 and obliquely toward a heel side of the club head 22.

FIG. 3 shows a positional relationship between the club head 22 and a golf ball 34, when viewed by a spectator from a point above the club head 22 while a player using the iron club having the head 22 is addressing the golf ball 34. To the spectator, the boundary lines $BL_1$ and $BL_2$ appear to extend obliquely to a straight line X, as shown in FIG. 3, but to the player, the boundary lines $BL_1$ and $BL_2$ appear to substantially extend in parallel with the straight line X due to the oblique extension of the boundary lines $BL_1$ and $BL_2$ on the head 22 (FIG. 2). Accordingly, the player will move the club on the backswing in the direction designated by the boundary lines $BL_1$ and $BL_2$ which appear to extend in parallel with the straight line X, thereby causing the club to be swung in a straight line on the downswing, and thus preventing a slice of the ball.

The boundary lines $BL_1$ and $BL_2$ may be straight, but as shown in FIG. 2, are preferably curved to describe an arc so that, to the player, the boundary lines $BL_1$ and $BL_2$ will appear to extend along an orbit of the swing of the head 22 along a straight line.

A toe 3 of the head 22 may be shaped so that a profile thereof has an oblique form running parallel to the boundary lines $BL_1$ and $BL_2$. With this arrangement, it is possible to further enhance the tendency to make the player swing in a straight line. Preferably, the shaping of the toe 36 is performed in such a manner that a weight distribution of a body of the club head 22 is toward the toe side thereof, so that the moment of inertia of the head body is increased. According to this arrangement, when the head face 28 hits the ball at a point outside of the sweet point toward the toe side of the club head 22, the head body is not rotated around the center of gravity thereof, to prevent a slicing of the ball.

Preferably, the neck 24 of the club head 22 has a length H which is less than 55 mm so that a weight distribution of the head 22 is toward the head body rather than the neck side thereof, whereby the moment of inertia of the head body is further increased. This increase of the moment of inertia contributes to a prevention of the rotation of the head body when the head face hits the ball outside of the sweet point toward the toe side of the club head. This shortening of the neck length also prevents slicing. In particular, by shortening the neck length, the kick point of the shaft 26, from which the shaft is resiliently bent during a downswing of the club, is shifted toward the head side so that the shaft is quickly restored to a straight condition from the bent condition, whereby the club head can be prevented from hitting the ball in the "open face" manner.

As shown in FIG. 4, the club head 22 may have a recess 38 formed in the back face thereof and disposed in the vicinity of the heel side of the club head 22 so that a weight distribution of the head body is toward the toe side thereof, whereby the moment of inertia of the head body can be further increased. This arrangement also contributes to a prevention of the rotation of the club head 22 when the club face 28 hits the ball at the point outside of the sweet point toward the toe side of the club head 22.

Figure 5:
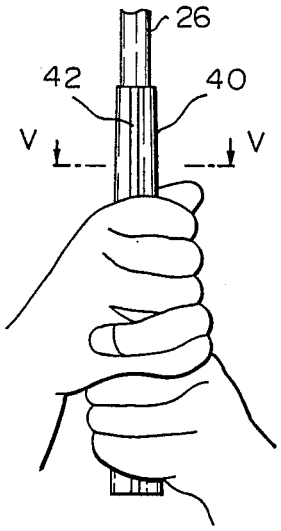
FIG. 5 illustrates a grip of an iron club in accordance with the present invention.
Figure 6:
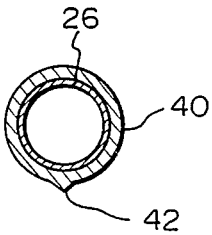
FIG. 6 is a cross-sectional view taken along the line III-III of FIG. 5.

As shown in FIGS. 5 and 6, the iron club according to the present invention may be provided with a grip 40, on an outer surface of which a ridge element 42 is formed to extend along an axis of the grip 40. As apparent from FIG. 5, the player can obtain a secure grasp on the grip 40 due to the ridge element 42, so that rotational slippage between the grip 40 and the player's hands is prevented when the club head 22 hits the ball, thus also preventing slicing.

Figure 7A:
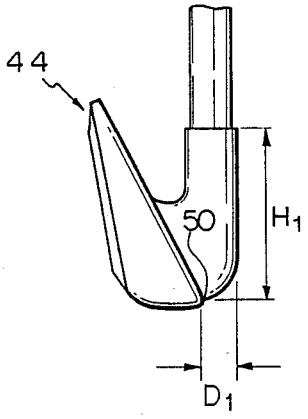
FIG. 7(*a*) illustrates a head of a long iron club in accordance with the present invention.
Figure 7B:
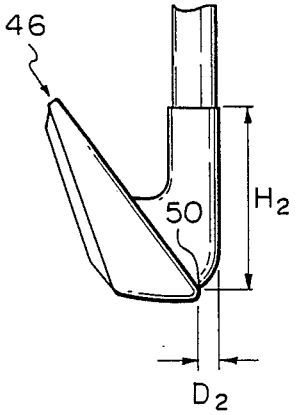
Figure 7C:
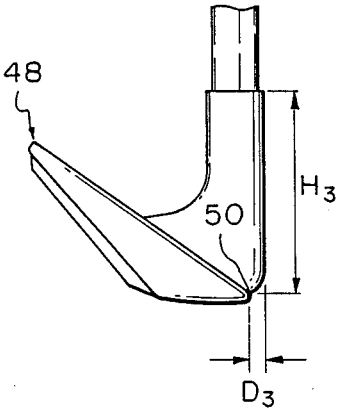

FIGS. 7(*a*), 7(*b*) and 7(*c*) show a head 44 of a long iron club, a head 46 of a middle iron club, and a head 48 of a short iron club, respectively, which are selected from a set of iron clubs according to the present invention. All of the club heads 44, 46, and 48 are constructed in the same manner as the club head 22. In other words, the club head 44, 46 and 48 at least feature the boundary lines defining the scored zone provided on the head face thereof, as explained with reference to FIGS. 2 and 3.

As apparent from FIGS. 7(*a*), 7(*b*) and 7(*c*), a relative position of a leading edge 50 of the club heads 44, 46 and 48 with respect to the corresponding club shaft is regulated in accordance with a shaft length. In particular, goose distances $D_1$, $D_2$, and $D_3$ of the club head 44, 46 and 48 have the following relationship:

$$D_1 > D_2 > D_3$$

In short, in the set of iron clubs according to the present invention, as the shaft length becomes longer, the goose distance becomes larger, so that a timing of the impact of the club head with the ball is further delayed as the club shaft becomes longer, thus preventing the club from hitting the ball in the "open face" manner.

It should be also noted that the neck lengths $H_1$, $H_2$, and $H_3$ of the club heads 44, 46, and 48 have the following relationship:

$$H_1 < H_2 < H_3$$

As is well known, in a set of iron clubs, the weight of the club head becomes lighter as the length of the shaft becomes longer, whereby the same moment of inertia is felt for all of the iron clubs during a swing thereof. Therefore, a body per se of the club head 44 has a moment of inertia which is less than that of a body of the club head 48. In other words, the moment of inertia of the head body per se is reduced as the length of a shaft becomes longer. This means that as the shaft length becomes longer, the club head is more liable to rotate when the head face hits the ball at the point outside of the sweet point toward the toe side of the club head. With the arrangement wherein the neck length of the club head becomes shorter as the shaft length becomes longer, it is possible to further increase the moment of inertia of the head body per se as the shaft length becomes longer, whereby even the club head of the long iron is not rotated and thus the ball is not sliced.

In the embodiment as mentioned above, the relative position of the leading edge of the club head with respect to the club shaft is represented by the goose distance, but it is possible to use an offset distance for representing the relative position of the leading edge and the club shaft.

Although specific embodiments of the present invention are described herein, it will be obvious to those skilled in the art that modifications and variations of the invention are possible.

I claim :

1. In an iron club having a shaft, a head having a toe profile provided at one end of said shaft, and a grip provided at the other end of said shaft, said iron club, comprising: indication means provided on said head for indicating a direction in which a player should move the iron club on a backswing when addressing a ball and for ensuring by a player that a downswing is on a straight line, wherein said indication means comprises a pair of boundary lines which define a scored zone formed on a face of said head, wherein said pair of boundary lines extending upwardly from a sole of said head and obliquely toward a heel side of said head to describe a pair of circular arcs in parallel so that said pair of boundary lines appear to substantially extend in parallel with a straight line when a player is addressing the ball and appear to accord with an orbit of a swing of said head along a straight line, wherein said toe profile of said head is formed in an oblique shape in parallel with said pair of boundary lines in such a manner that a weight distribution of a body of said head is toward the toe side thereof so that a moment of inertia of said head body, when swung, is further increased.

2. An iron club as set forth in claim 1, wherein a neck of said head has a length which is less than 55 mm so that a weight distribution of said head is toward said head body rather than the neck side thereof, whereby the moment of inertia of the head body is further increased.

3. An iron club as set forth in claim 2, wherein said head has a recess formed in a back face thereof, and disposed in the vicinity of the heel side of said head so that a weight distribution of said head body is toward the toe side thereof, whereby the moment of inertia of said head body is further increased.

4. An iron club as set forth in claim 3, wherein said grip has a ridge element formed on the outer surface thereof, and extending along an axis thereof so that a rotational slippage between said grip and hands of a player is prevented when said head hits the ball.

5. An iron club as set forth in claim 1, wherein said head has a recess formed in a back face thereof, and disposed in the vicinity of the heel side of said head so that a weight distribution of said head body is toward the toe side thereof, whereby the moment of inertia of said head body is further increased.

6. An iron club as set forth in claim 1, wherein said grip has a ridge element formed on the outer surface thereof, and extending along an axis thereof so that a rotational slippage between said grip and hands of a player is prevented when said head hits the ball.

7. In a set of iron clubs, each having a shaft, a head having a toe profile provided at one end of said shaft, and a grip provided at the other end of said shaft, said iron club, comprising: indication means provided on said head for indicating a direction in which a player should move the iron club on a backswing when addressing a ball and for ensuring by said player that a downswing is along a straight line, wherein said indication means comprises a pair of boundary lines which define a scored zone formed on a face of said head, wherein said pair of boundary lines extending upwardly from a sole of said head and obliquely toward a heel side of said head so that the pair of boundary lines appear to substantially extend in parallel with a straight line when a player address the ball, wherein as said shaft becomes longer, an offset distance between a leading edge of said head and an axis of said shaft or a goose distance between a leading edge of said head and a leading side of said shaft is increased so that a timing of an impact of said head with ball is further delayed as said shaft becomes longer, wherein said toe profile of said head is formed in an oblique shape in parallel with said pair of boundary lines in such a manner that a weight distribution of a body of said head is toward the toe side thereof so that a moment of inertia of said head body, when swung, is further increased.

8. A set of iron clubs as set forth in claim 7, wherein a neck of said head has a length which is less than 55 mm so that a weight distribution of said head is toward said head body rather than the neck side thereof, whereby the moment of inertia of the head body is further increased, and wherein the neck length of said head becomes shorter as the shaft length becomes longer, whereby the moment of inertia of the head body per se is further increased as the shaft length becomes longer.

9. A set of iron clubs as set forth in claim 11, wherein said head has a recess formed in a back face thereof, and disposed in the vicinity of the heel side of said head so that a weight distribution of said head body is toward the toe side thereof, whereby the moment of inertia of said head body is further increased.

10. A set of iron clubs as set forth in claim 11, wherein said grip has a ridge element formed on the outer surface thereof, and extending along an axis thereof so that a rotational slippage between said grip and hands of a player is prevented when said head hits the ball.

11. In a set of iron clubs, each having a shaft, a head having a toe profile provided at one end of said shaft, and a grip provided at the other end of said shaft, said iron club, comprising: indication means provided on said head for indicating a direction in which a player should move the iron club on a backswing when addressing a ball and for ensuring by said player that a downswing is along a straight line, wherein said indication means comprises a pair of boundary lines which define a scored zone formed on a face of said head, wherein said pair of boundary lines extending upwardly from a sole of said head and obliquely toward a heel side of said head so that the pair of boundary lines appear to substantially extend in parallel with a straight line when a player addresses the ball, wherein as said shaft becomes longer, an offset distance between a leading edge said head and an axis of said shaft or a goose distance between a leading edge of said head and a leading side of said shaft is increased so that a timing of an impact of said head with a ball is further delayed as said shaft becomes longer, wherein said pair of boundary lines extends to form a pair of circular arcs in parallel with each other and appearing to accord with an orbit of a swing of said head along a straight line, and wherein said toe profile of said head is formed in an oblique shape in parallel with said pair of boundary lines in such a manner that a weight distribution of a body of said head is toward the toe side thereof so that a moment of inertia of said head body, when swung, is further increased.

12. A set of iron clubs as set forth in claim 11, wherein a neck of said head has a length which is less than 55 mm so that a weight distribution of said head is toward said head body rather than the neck side thereof, whereby the moment of inertia of the head body is further increased, and wherein the neck length of said head becomes shorter as the shaft length becomes longer, whereby the moment of inertia of the head body per se is further increased as the shaft length becomes longer.

13. A set of iron clubs as set forth in claim 12, wherein said head has a recess formed in a back face thereof, and disposed in the vicinity of the heel side of said head so that a weight distribution of said head body is toward the toe side thereof, whereby the moment of inertia of said head body is further increased.

14. A set of iron clubs as set forth in claim 13, wherein said grip has a ridge element formed on the outer surface thereof, and extending along an axis thereof so that a rotational slippage between said grip and hands of a player is prevented when said head hits the ball.

* * * * *